US005659910A

United States Patent [19]

Weiss

[11] Patent Number: 5,659,910

[45] Date of Patent: Aug. 26, 1997

[54] WHEELCHAIR AND BED WITH MOVABLE BODY SUPPORTING PORTIONS

[76] Inventor: Norman Weiss, 1126 W. 228th St. #22, Torrence, Calif. 90502

[21] Appl. No.: 511,533

[22] Filed: Aug. 4, 1995

[51] Int. Cl.[6] ..... A61G 7/015; A61G 5/00

[52] U.S. Cl. ..... 5/618; 5/613; 5/934; 601/92; 601/98; 297/284.3; 297/423.3; 297/DIG. 4

[58] Field of Search ..... 5/613, 611, 86.1, 5/618, 653, 934, 620; 297/284.3, 423.3, DIG. 4; 601/92, 90, 91, 97, 98, 100

[56] References Cited

U.S. PATENT DOCUMENTS

| | | | |
|---|---|---|---|
| 2,587,068 | 2/1952 | Sanders | 5/86.1 |
| 2,694,437 | 11/1954 | Glaser | 297/DIG. 4 |
| 2,790,440 | 4/1957 | Adair, Jr. | 5/934 |
| 3,147,039 | 9/1964 | Smith et al. | 297/DIG. 4 |
| 3,215,469 | 11/1965 | Wamsley | 5/618 |
| 3,298,363 | 1/1967 | Parkin | 5/934 |
| 4,717,169 | 1/1988 | Shaffer | 297/DIG. 4 |
| 4,974,905 | 12/1990 | Davis | 297/DIG. 4 |
| 5,083,551 | 1/1992 | Addison, Jr. | 601/134 |
| 5,233,712 | 8/1993 | Jurus et al. | 5/613 |
| 5,333,887 | 8/1994 | Luther | 297/DIG. 4 |
| 5,342,114 | 8/1994 | Burke et al. | 5/618 |
| 5,402,544 | 4/1995 | Crawford et al. | 5/616 |

FOREIGN PATENT DOCUMENTS

| | | | |
|---|---|---|---|
| 2645014 | 10/1990 | France | 5/934 |
| 542837 | 10/1957 | Italy | 601/92 |
| 1009787 | 10/1965 | United Kingdom | 5/933 |

*Primary Examiner*—Alexander Grosz

[57] ABSTRACT

A convertible wheel chair/bed for paralyzed invalids comprises a support on which the invalid rests, the support comprising a plurality of support segments which define a support surface. The support segments can be moved simultaneously so the parts of the skin which were in contact with some support segments are relieved from pressure and exposed to air so that perspiration on that portion of the skin can evaporate, while other parts of the skin of the invalid are engaged and supported by support segments.

6 Claims, 4 Drawing Sheets

FIG. 8.
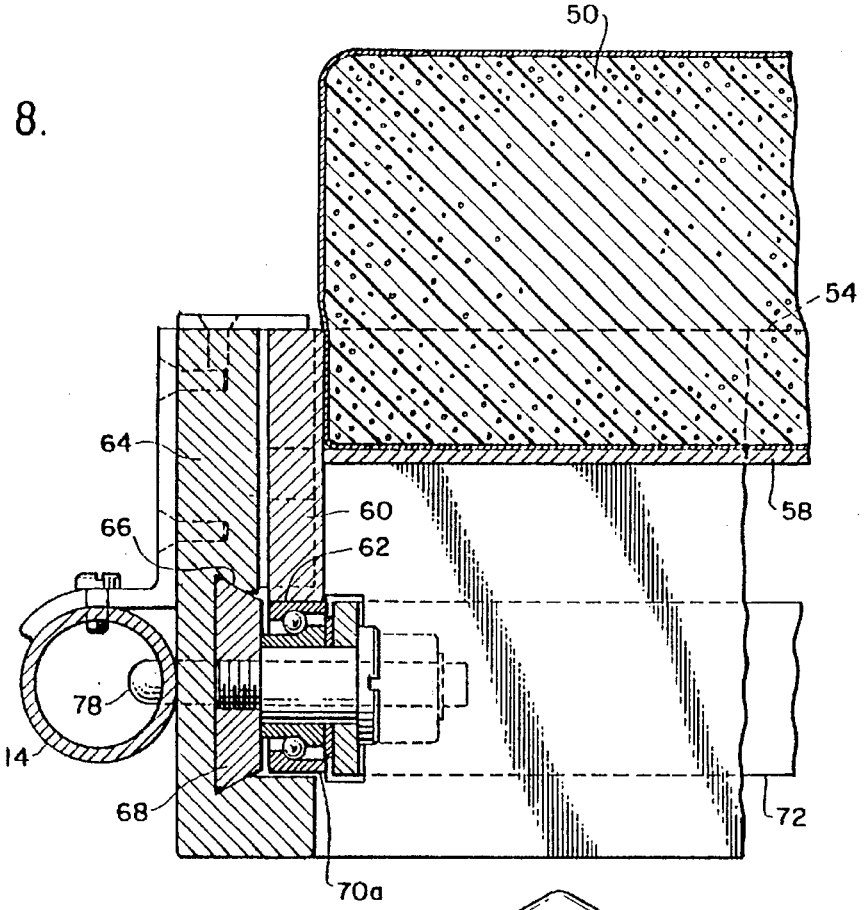
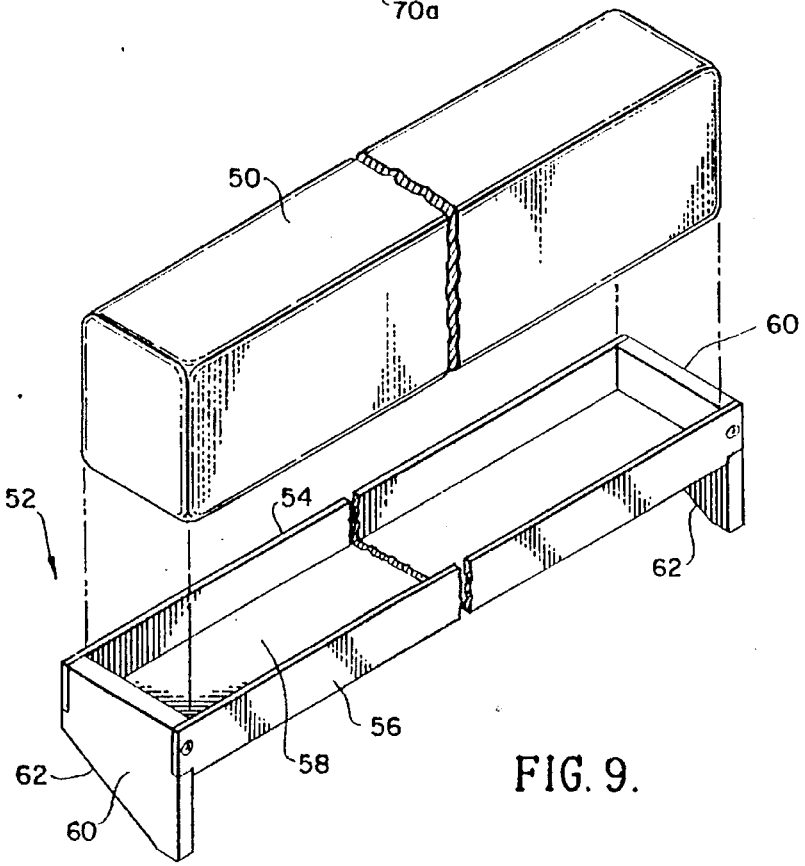
FIG. 9.

WHEELCHAIR AND BED WITH MOVABLE BODY SUPPORTING PORTIONS

This invention relates to a wheel chair which can be converted into a bed, and more particularly to a convertible wheel chair and/or bed which has an automatic mechanism designed to prevent bed sores.

FEDERALLY SPONSORED RESEARCH

No part of this patent application was developed with the aid of any federally sponsored research and development.

BACKGROUND AND PRIOR ART

Invalids, particularly those persons who are completely or almost completely paralyzed, have many important medical problems. These include the development of bed sores which are caused by long continued pressure caused by the weight of the body on areas of the skin in contact with the mattress or sheet. Bed sores, when they occur are dangerous to the health of the invalid. In addition they are difficult to cure and expensive to treat because the fragile condition of the patient requires extra care to move the patient without causing pain or increasing injury.

Heretofore, much thought has been given to the solution of these problems. A basic approach has been to change the distribution of the weight of the body on the bed. Some approaches are illustrated by the United States patents to Munch U.S. Pat. No. 3,742,528, Skeffington U.S. Pat. No. 1,040,795, Lamont U.S. Pat. No. 1,295,770, Rand U.S. Pat. No. 595,734, Groff U.S. Pat. No. 218,016, Italian #471002, and Keathley Sr. U.S. Pat. No. 2,932,831.

BRIEF SUMMARY OF THE INVENTION

The structure described herein for automatically preventing or minimizing the occurrence of bed sores in patients has two configurations. These are a bed configuration and a wheel chair configuration.

In the bed configuration, the mattress comprises a plurality of seperate narrow mattress segments resting on individual supports in spaced parallel relationship to each other. The supports for alternate mattress segments are connected together forming two groups of mattress segments. The supports in each group are movable in such a way that each mattress segment in a group can be moved simultaneously into and out of engagement with the body of a patient and mounted so the supports in one group of mattress segments moves in a direction opposite to the direction of movement of the supports in the other group. In this way, without disturbing the patient, as one group of mattress segments moves into engagement with the body of a patient, the mattress segments in the second group simultaneously moves out of engagement with the body of the patient. The mattress segments are narrow so that the increase in pressure on adjacent portions of the skin, when a group of mattress segments moves into engagement with the body of the patient is comparatively small so that additional bed sores are not created. In addition, since all the mattress segments are the same size, and there are the same number of mattress segments in each group, the support surface on which the patient rests or sits is generally constant.

Moreover, the frame of the bed is hinged, so that without disturbing the patient, the portion of the bed from the buttocks to the head can be pivoted into a comparatively vertical position in a wheel chair configuration where the patient is in a sitting position. The seat portion of the wheel chair is also adjustable so that the pressure on various areas of the buttocks of the patient can be varied by changing the areas of contact between the buttocks of the patient and the seat of the wheel chair.

These and other objects of this invention will become more apparent when better understood in the light of the accompanying specification and drawings wherein:

FIG. 8 is a partial cross sectional view taken along the line 8—8 of FIG. 7 showing additional details of the operating mechanism.

FIG. 9 is an exploded perspective view of a mattress segment and its support holder.

Figure 1:
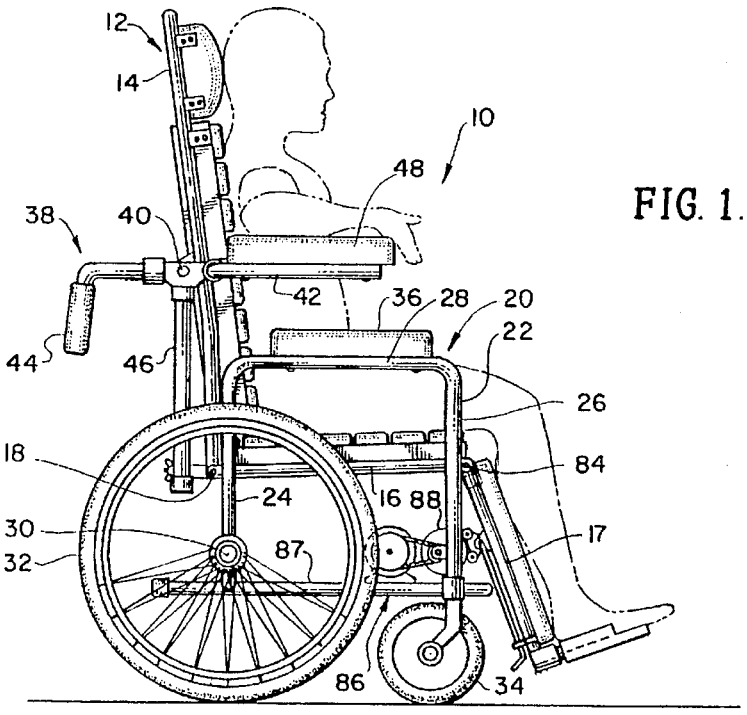
FIG. 1 is a side elevational view of the combined invalid bed and wheel chair constructed according to the principles of this invention showing the invention in the wheel chair configuration.

Referring now to FIG. 1 of the drawing, a combined invalid bed and wheel chair indicated generally by the reference numeral 10 is shown in a wheelchair configuration. The wheel chair comprises an outer support frame 12. The frame comprises a tubular upper frame portion 14 which is pivotally connected to a lower tubular frame portion 16 at pivots 18, see FIGS. 1, 2, and 3. This permits the upper portion 14 to be pivoted from a bed configuration to a comparatively vertical wheel chair configuration.

A wheel support frame 20 comprising left and right generally U-shaped tubular wheel support frame portions are secured to the left and right sides of the lower portion 16 of the outer support frame 12. The wheel support frame 20 include a first vertical tubular support member 22 and a second parallel vertical tubular support member 24. These are connected together by a horizontal tubular connecting member 28, see FIG. 2.

Figure 2:
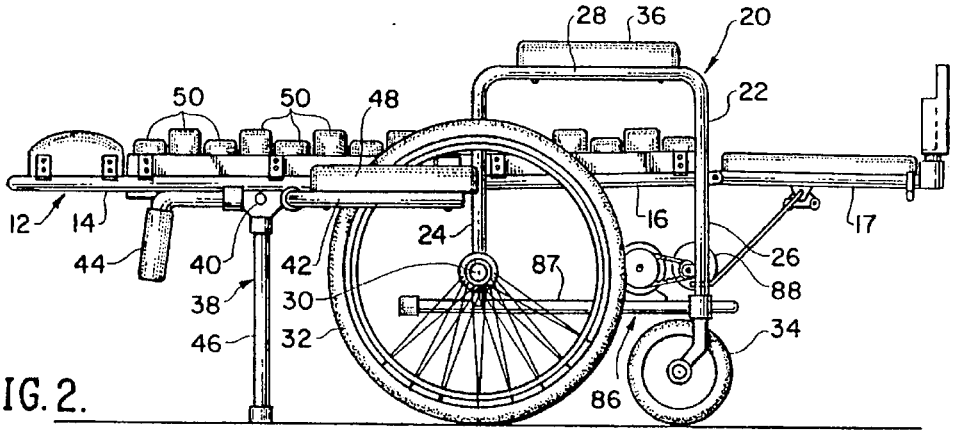
FIG. 2 is a side elevational view of the combined invalid bed and wheel chair in the bed configuration.
Figure 3:
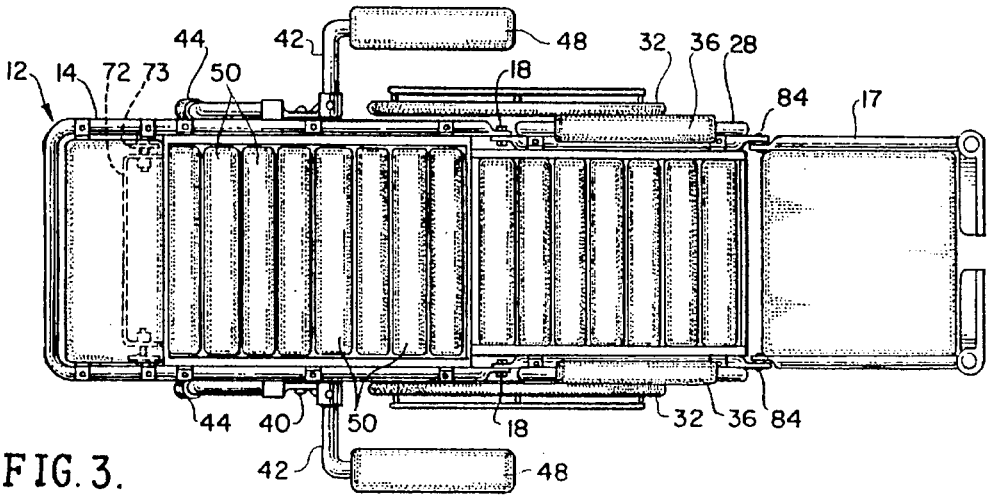
FIG. 3 is a top plan view of the combined invalid bed and wheel chair shown in FIG. 2.

The axis 30 of the left and right major wheels 32 of the combined invalid bed and wheel chair is rotatably connected to the bottom portion of the tubular support 24 by any suitable means. Similarly, the secondary smaller wheels 34 are pivotally connected to the bottom portion 26 of the tubular support 22. In this way, the combined invalid bed and wheel chair may be easily guided. As shown in FIGS. 1 and 2, a first arm rest 36 is secured to the horizontal tubular connecting member 28 to support the arms of the invalid.

A bed support frame 38, see FIGS. 1 and 2 has left and right portions. These portions comprises floor engaging legs 46 and transverse second arm supports 42. The floor engaging legs 46 are pivotally connected to the outer tubular support frame 12 at pivot 40, so the floor engaging legs 46 are generally aligned with the tubular support bar 14 in the wheel chair configuration, see FIG. 1.

In the bed configuration, the legs 46 are pivoted so they are generally transverse to the tubular support rods 14, see FIG. 2. The rearwardly extending portion of the transverse second arm supports 42 curves down to provide push handles 44 for the wheel chair. When the wheel chair is changed to the invalid bed configuration shown in FIG. 2, the floor engaging legs 46 rest on the floor. The engagement of the support leg 46 with the floor of the room in the bed configuration prevent the combined bed and wheel chair from rolling freely. However, a slight lifting effort on the handles 44 (depending on the length of arm support 42) is sufficient to raise the floor engaging legs 46 out of contact with the floor thus making the combined bed and wheel chair freely moveable without raising the end of the bed high enough to disturb the patient.

A pad 48 secured to the to the second arm support 42. This structure is higher than the first arm support 36 and is positioned to engage the arms of the patient. The purpose of pad 48 is to permit a patient who has control of his arms and shoulders to exert enough downward force on the pad 48 to lift some of his body weight to move his body in order to temporarily relieve and shift the weight on his buttocks. It is contemplated that the second arm support 42 may be vertically adjustable by any suitable means well known in the art, to accommodate the size of the patient.

As stated above, paralyzed bed-ridden patients tend to develop bed sores. The development of these sores can be minimized but not entirely eliminated by having the medical personnel frequently move the patients body to redistribute the pressure on the patient's skin. This procedure is costly and time consuming for the medical personnel and when the personnel were not available, bed sores tended to develop.

Figure 5:
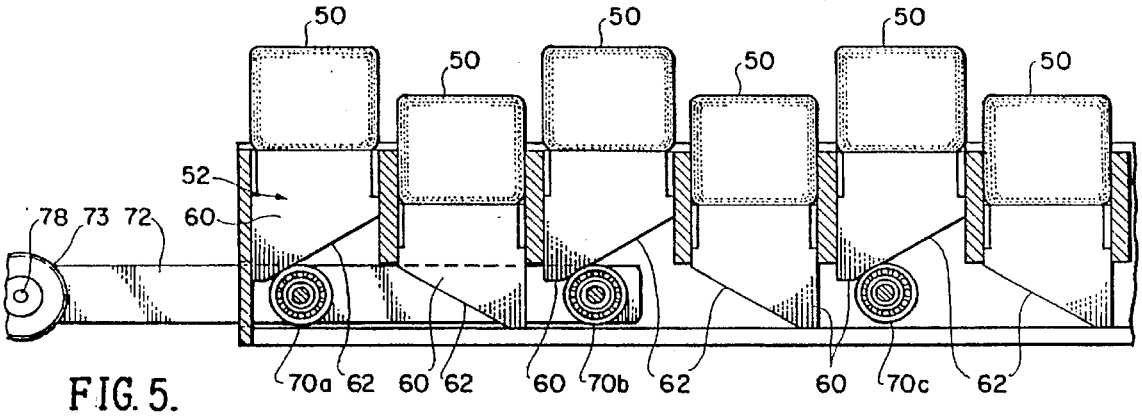
FIG. 5 is a partial side sectional view of the mattress segments shown in FIG. 4, but illustrating the position of the mechanism for operating the mattress segments where one group of alternate segments are raised while the other group of alternate mattress segments are lowered.
Figure 6:
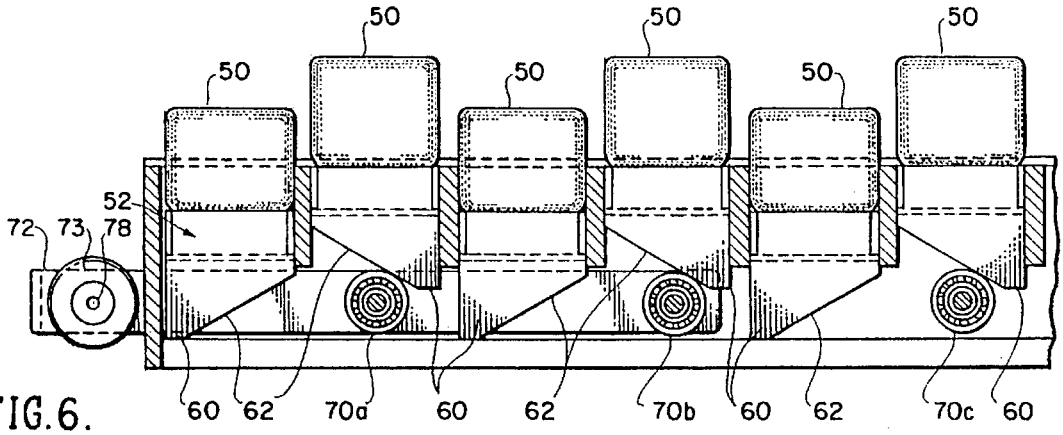
FIG. 6 is a partial side sectional view of the mattress segments shown in FIGS. 4 and 5, but with the mechanism in position where the lowered group of mattress segments shown in FIG. 5 are raised while the group of mattress segments that were raised in FIG. 5, are lowered.

The mechanism for preventing or reducing the incidence of bed sores, reduces the need for medical personnel to shift the position of the patient on the bed or wheel chair because it can operate automatically to relieve prolonged pressure on the skin of the person sitting or laying in the combined wheel chair and bed. To do this, the mattress of the combined bed and wheel chair is formed from a plurality of narrow mattress segments 50 connected together into two groups in such a way that the mattress segments in each group can be moved as a unit, see FIGS. 4, 5, and 6. Each mattress segment 50 extends the width of the bed and is movably mounted in a support 52, see FIG. 9. The supports 52 have divider walls 54 and 56, a base wall 58, and end walls 60. The end walls 60 have inclined bottom edges 62 which serve as cams for reasons to become apparent below.

Figure 4:
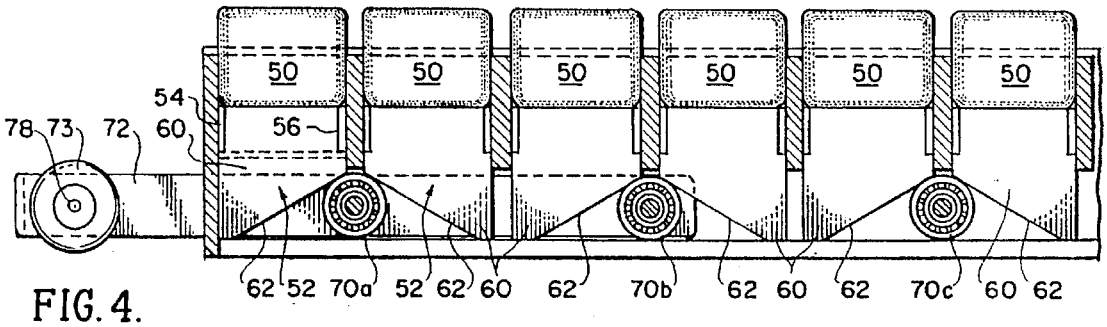
FIG. 4 is a partial side sectional view of the mattress segments forming the mattress of the invalid bed and showing their position when they are all the at the same level.
Figure 7:
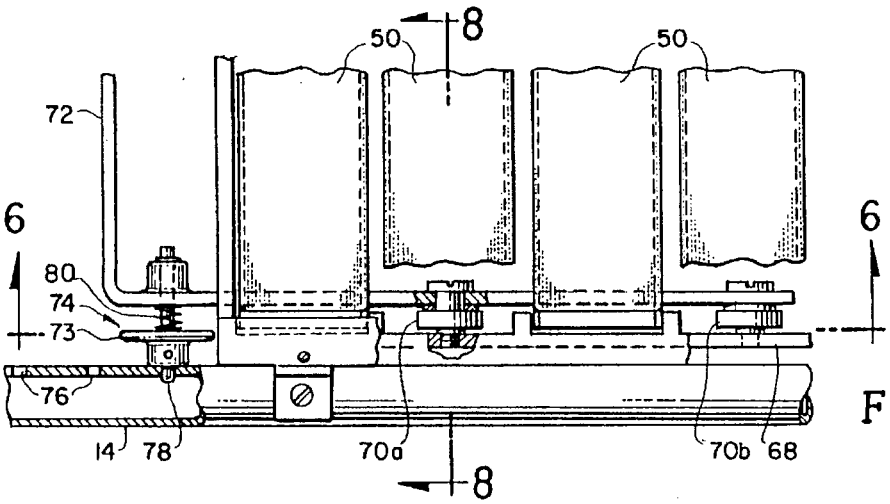
FIG. 7 is a partial plan view showing a portion of the mechanism used to raise and lower the alternate groups of mattress segments.

The tubular upper portion 14 of the frame is secured to the side frame 64 on each side of the bed, see FIG. 8. A dove-tail slot 66 is formed in each side frame for receiving a slide bar 68 which is dove-tailed in cross section and is sized to slide in slot 66, see FIG. 8. A plurality of rollers 70*a*, 70*b*, 70*c*, etc. are mounted in uniformly spaced relationship to each other on each slide bar 68 as shown in FIGS. 4 and 7. The ends of the dove tail slide bars terminate in a U-shaped pull handle 72, see FIG. 4 and 7. In this way, by pulling or pushing the handle 72, for manual operation, the rollers 70 on both sides of the bed can be moved horizontally either forward or backward, compare FIGS. 4, 5, and 6. The cam edges 62 of the end walls 60 of the supports 52, ride on these rollers, and as the slide bars 68 are pulled out or pushed in, the rollers engage the cam edges 62 causing the supports 52 carrying the mattress segments 50 to rise or descend. In this way, personnel can by pulling or pushing the handle 72 raise one group of mattress segments, thereby lowering the other group of alternate mattress segments. It is noted that this arrangement has been accomplished without moving the patient and can be done by a person in a very short time.

In this way prolonged pressure on the skin of the patient caused by the weight of the body can be quickly and easily prevented. Moreover, as stated above, since the mattress segments are narrow, the increase in pressure on the new areas of the patients skin caused when the second group of mattress segments move into engagement with it, is comparatively small so that the incidence of new bed sores will be minimized.

As shown in FIG. 7, a locking mechanism 74 is provided for locking the slide bar 68 in one of three positions. These positions are determined by the position of holes 76 in the tubular frame 14 through which a plunger 78 extends to lock the slide bar 68. The locking mechanism 74 includes a spring 80 which is compressed between the outer surface of the pull handle 72 by an actuating washer-like handle 73 which is attached to the plunger 78. It is evident that by squeezing the washer-like handle 73 against the pull handle 72, the plunger 78 retracts from the holes 76 in the tubular bar frame 14 permitting the slide bars 68 on both sides of the bed to be shifted as the plunger 78 is snapped into an adjacent hole 76, to thereby lock the groups of alternate mattress segments 50 in another fixed position.

Although the mechanism for raising and lowering alternate groups of mattress segments 50 described to this point are shown manually, it is evident and it is contemplated that the alternate groups of mattress segments may be raised and lowered automatically at controlled intervals of time by connecting well know reciprocating mechanisms such as the mechanism 86 shown diagrammatically in FIG. 2, to the slide bars 68 by any suitable means.

As previously stated, it is harmful for the human body to lie in a prone position for an extended period of time. To overcome this problem, the combined bed and wheel chair shown in FIG. 3, can be easily converted to a wheel chair without disturbing the patient, because the upper and lower portions 14 and 16 are pivotally connected at pivot 18.

As seen in FIG. 1, the lower portion 16 of the bed frame has a pivotal connection on pivots 84 defining a pivotally connected leg and foot support end frame 17. The pivots 84 correspond generally to the position of the knee joints of the patient, and when the bed is converted to a wheel chair the lower portion 16 of the bed frame pivots at 84 so the legs of the patient can bend normally.

Figure 10:
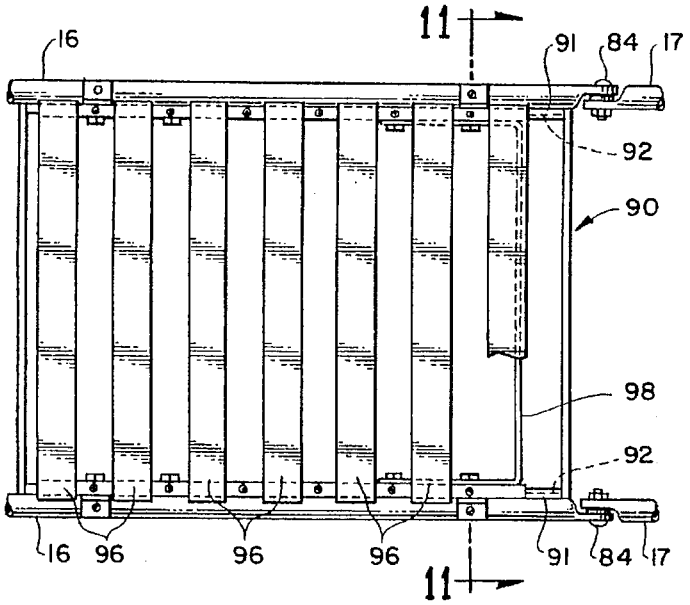
FIG. 10 is an alternate embodiment of the seat portion of the combined invalid bed and wheel chair in the wheel chair configuration.
Figure 11:
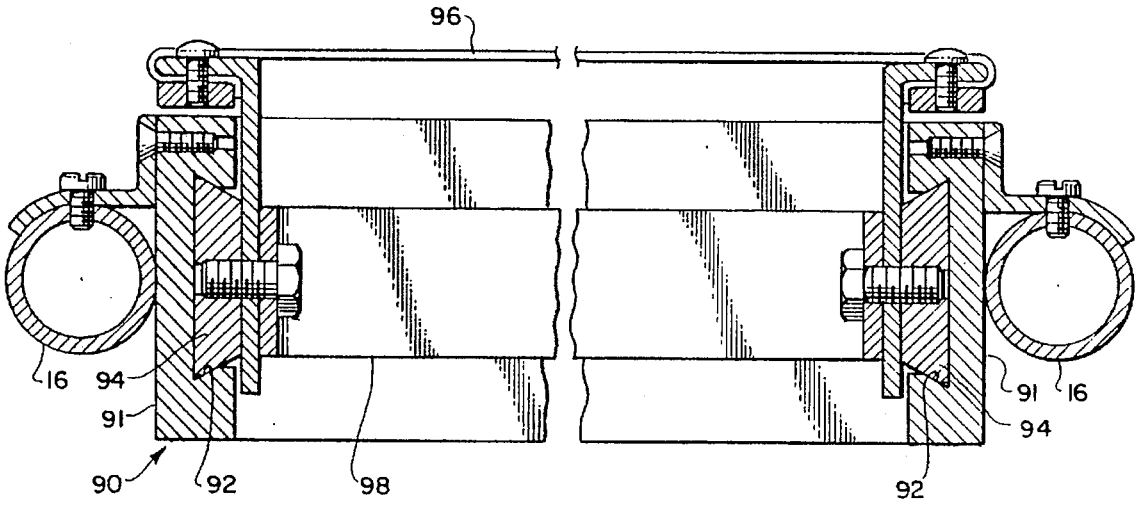
FIG. 11 is a cross sectional view taken on the line 11—11 of FIG. 10 showing the mechanism for adjusting the modified seat portion of the wheel chair shown in FIG. 10.

In order to exercise the leg muscles and knee joints of the patient, a reciprocating mechanism, indicated generally by the reference numeral 86 is mounted onto an integral cross frame 87 connected to the wheel support frame 20, see FIGS. 1 and 2. This mechanism, by means of a conventional rotating eccentric cam 88 oscillates the leg and foot support frame 17 up and down at a controlled speed, to passively exercise the lower extremities of the body. An alternate embodiment of the lower frame 16 forming the seat is shown in FIGS. 10 and 11. In this embodiment, a rectangular first frame 90 is attached to the tubular frame 16, see FIG. 11. Dove-tail slots 92 are formed in the opposing sides 91 of the fame 90, see FIG. 11. Slide bars 94, defining a second frame, are dove-tailed in cross section. These bars are slidably mounted in the dovetail slots 92 making the second frame slidable on the first frame. A plurality of spaced seat support straps or mattress segments 96 which may be formed from a suitable web or mesh material are connected between the opposing slide bare 94, see FIG. 10. With this arrangement, by pulling the handle 98, the position of all the seat support straps 96 can be shifted as a unit. In this way, when the combined bed and wheel chair is in the wheel chair configuration, the patient may be able to press his arms down on the arm supports 48 with enough strength to raise himself on the arm supports 48, while an attendant, or a mechanism attached to the handle 98 shifts the position of the Seat support straps 96. When the patient lowers himself, the support straps 16 have been moved so they engage a different portion of his buttocks, thereby distributing the pressure of his weight to a different surface area of his buttocks, thus decreasing the incidence of bed sores.

It is also noted that in the invalid bed configuration and in the wheel chair configuration, when the support segments move out of engagement with a portion of the skin of the patient, that portion of the skin is exposed to the air and is ventilated so that perspiration on that portion of the skin can evaporate further inhibiting the formation of bed sores caused in part when perspiration is trapped against the skin subjected to pressure for long periods of time.

Having described the invention, what I claim as new is:

1. A convertible wheelchair/bed (10) for paralyzed invalids comprises a support frame (12), said support frame having two portions, (14 and 16), said portions pivotally connected to each other, means (pivot 18) for pivoting one portion of the support frame from a bed position where the entire frame is horizontal, to a wheel chair position where the said one portion of the frame is generally perpendicular to the remainder of the frame defining thereby a seat portion and a back rest portion, said seat portion including a first frame (90) and a second frame (94), said first frame connected to said support frame (16), said second frame mounted for movement on said first frame, support segments (96) mounted on said second frame in spaced relationship to each other and in such a way that the support segments on said second frame move as a unit when said second frame is moved, whereby when an invalid sits on said seat portion, one portion of his buttocks engages and is supported by some of the spaced support segments (96) on said second frame, and when said second frame is moved, another portion of his buttocks engages and is supported by other of the spaced support segments (96), to relieve pressure and provide ventilation to said one portion of the buttocks to prevent the development of bed sores.

2. A wheel chair for paralyzed invalids comprising a support frame (12), said support frame including a back support and a seat portion, said seat portion comprising a first frame (90) and a second frame (94), said first frame connected to said support frame, a plurality of spaced seat support segments (96) mounted on said second frame(94) to engage and support the buttocks of the invalid sitting in the wheel chair, said second frame (94) movably mounted on said first frame (90) so the seat support segments on said second frame can be moved as a unit to shift the area of pressure caused by the weight of the body of the person sitting in the chair from one area of the buttocks to another area to expose said one area of the buttocks to the air to provide ventilation to the areas of the skin of the buttocks which have been relieved from pressure so that perspiration on that area of the skin can evaporate, whereby the development of bed sores is prevented.

3. The wheel chair described in claim 2 wherein said wheel chair has first and second arm rests (36 and 48), said second arm rest positioned above said first arm rest and vertically adjustable so that invalids sitting in the wheel chair who have strength in their arms can exert pressure on said first or second arm rest to raise their buttocks above the seat support segments (96) on the second frame, to permit the second frame with its seat support segments to be moved in order to shift the pressure caused by the weight of his body from one portion of his buttocks to another.

4. The wheel chair described in claim 3 wherein said first frame has a pivotally connected end frame, said end frame pivotal to a generally vertical position with respect to the first frame, and means connected to said end frame to repeatedly pivot said end frame portion from a vertical position to a less vertical position so that the legs of an invalid sitting in the wheel chair with his legs engaging said end frame portion are repeatedly raised and lowered to exercise the invalid's leg muscles.

5. A convertible wheelchair/bed for paralyzed invalids comprising a support frame (12), said support frame having two frame portions (14 and 16), said portions pivotally connected to each other by means (18) for pivoting one portion of the support frame from a bed position where the entire frame is horizontal, to a wheel chair position where the said one portion of the frame is generally perpendicular to the remainder of the frame defining thereby a seat portion and a back rest portion, a plurality of support segments (50,96) movably mounted on said support frame, means for moving said support segments on said support frame so that the parts of the skin which were in contact with the support segments are relieved from pressure caused by the weight of the body by the movement of said support segments so that perspiration on that portion of the skin of the body can evaporate, while other parts of the skin of the invalid are engaged and supported by other support segments, said support segments being mattress segments disposed in closely spaced parallel relationship to each other and extending across the width of the bed, said mattress segments connected together in two groups of alternate mattress segments, each mattress segment mounted on a support, the supports in each group connected together, cam means on the base of each support segment, slide bars movably mounted on said support, a plurality of rollers mounted on said slide bars, said rollers positioned to engage said cam means in such a way that moving said slide bars in one direction causes said rollers to engage said cams to raise one group of mattress segments into contact with the body of the invalid while at the same time the mattress segments in the other group are moved out of contact with the body of the invalid.

6. A convertible wheelchair/bed for paralyzed invalids comprising a support frame (12), said support frame having two frame portions (14,16), said frame portions pivotally connected to each other, means (18) for pivoting one portion of the support frame from a bed position where the entire frame is horizontal, to a wheel chair position where the said one portion of the frame is generally perpendicular to the remainder of the frame defining thereby a back portion and a seat portion, said seat portion including a first frame (90) mounted on said support frame (12) and a second frame (94), said second frame mounted for movement on said first frame, a plurality of spaced seat support segments (96)

mounted at least on said second frame, means (98) for moving said support segments as a unit with said second frame so that the parts of the skin of the buttocks of the invalid sitting in the wheel chair, which were in contact with some of the support segments on the second frame are relieved from pressure and exposed to air caused by the movement of said second frame with its support segments, whereby perspiration on that portion of the skin of the buttocks exposed to air can evaporate, while other parts of the skin of the buttock are engaged and supported by other of said support segments on said second frame.

* * * * *